United States Patent [19]

Tatara

[11] 4,317,191

[45] Feb. 23, 1982

[54] MOVING COIL PICKUP CARTRIDGE

[75] Inventor: Shokichi Tatara, Kanagawa, Japan

[73] Assignee: Sony Corporation, Tokyo, Japan

[21] Appl. No.: 109,995

[22] Filed: Jan. 7, 1980

[30] Foreign Application Priority Data

Jan. 17, 1979 [JP] Japan ..... 54-4293
May 24, 1979 [JP] Japan ..... 54-64179

[51] Int. Cl.[3] ..... H04R 9/04; H04R 9/16
[52] U.S. Cl. ..... 369/147; 369/145
[58] Field of Search ..... 179/100, 41 R, 41 D, 179/41 K, 41 M; 369/135, 136, 138, 139, 145, 147

[56] References Cited

U.S. PATENT DOCUMENTS 3,766,330 10/1973 Hepp et al. ..... 179/100.41 D
3,963,880 6/1976 Ikeda ..... 179/100.41 D
4,090,039 5/1978 Mori et al. ..... 179/100.41 D
4,145,582 5/1979 Nakatsuka ..... 179/100.41 K

FOREIGN PATENT DOCUMENTS 2003700 3/1979 United Kingdom ..... 179/100.41 D

*Primary Examiner*—James W. Moffitt
*Assistant Examiner*—Donald McElheny, Jr.
*Attorney, Agent, or Firm*—Hill, Van Santen, Steadman, Chiara & Simpson

[57] ABSTRACT

In a moving coil pickup cartridge of a stereophonic type having a magnetic circuit consisting of a permanent magnet, a plate and a yoke, left and right air gaps formed in the magnetic circuit, and left and right pickup coils disposed in the air gaps, respectively, the cartridge including left and right pole pieces formed in the magnetic circuit for providing cone-shape magnetic fluxes on each of the air gaps so as to cross the left and right pickup coils. respectively. Stylus exchanging mechanism is also disclosed.

8 Claims, 11 Drawing Figures

MOVING COIL PICKUP CARTRIDGE

BACKGROUND OF THE INVENTION

1. Field of the Invention

This invention relates generally to a moving coil pickup cartridge and is directed more particularly to a pickup cartridge of a stereophonic type having a novel magnetic circuit.

2. Description of the Prior Art

In general, a moving coil pickup cartridge is formed of a magnet, a first pole piece fixed to, for example, an N-pole surface of the magnet, a second pole piece fixed to an S-pole surface of the magnet, a magnetic gap established between the first and second pole pieces, and detecting coils for left and right channels located in the magnetic gap with the positional relation of 90° with each other. This kind of the cartridge also has a coil holder with the shape of a disc a part of whose peripheral surface faces the magnetic gap. A cantilever is extended from the central portion of the coil holder, and the detecting coils are respectively wound on projections planted on the outer periphery of the coil holder at the symmetrical positions with the above angles of 90°.

Since, in such a prior art moving coil pickup cartridge, the equivalent mass of the vibrating member (coil holder including the cantilever and detecting coils) and so on is great, the generating operation of the respective detecting coils in the magnetic field is low and also the conversion efficiency is poor. Further, in view of making the cartridge, the works to wind the coils are rather complicated and also scattering is easily caused in the characteristics of products.

OBJECTS AND SUMMARY OF THE INVENTION

Accordingly, an object of the present invention is to provide a novel moving coil pickup cartridge free from the defects encountered in the prior art.

Another object of the invention is to provide a moving coil pickup cartridge in which the equivalent mass of its vibrating member can be reduced by attaching generation coils through a support member fixed at the vibration fulcrum of a cantilever.

A further object of the invention is to provide a moving coil pickup cartridge which is high in generation efficiency by arranging generation coils so as to cross a cone-shape magnetic flux.

A further object of the invention is to provide a moving coil pickup cartridge in which all the periphery of generation coils can be contributed to generation by locating the generation coils of a spiral-shape in a cone-shape magnetic flux.

A still further object of the invention is to provide a moving coil pickup cartridge in which a stylus can be easily exchanged.

A yet further object of the invention is to provide a moving coil pickup cartridge in which even at the stylus exchange a generation portion is positioned correctly in a magnetic gap.

According to an aspect of the present invention, a moving coil pickup cartridge is provided which comprises:

(a) a magnetic circuit having at least a permanent magnet, a plate and a yoke;

(b) left and right air gaps formed in said magnetic circuit; and (c) left and right electrical signal generating means having a cantilever disposed in said left and right air gaps, respectively which is characterized by (d) left and right openings formed in said plate; and (e) left and right pole pieces opposed to said openings and formed in said magnetic circuit for providing cone-shape magnetic fluxes on each of said air gaps so as to cross said electrical signal generating means, said electrical signal generating means being attached to said magnetic circuit through a supporting block.

The other objects, features and advantages of the present invention will become apparent from the following description taken in conjunction with the accompanying drawings.

DESCRIPTION OF THE PREFERRED EMBODIMENTS

The present invention will be hereinafter described with reference to the attached drawings.

An example of the moving coil pick-up cartridge according to the present invention will be now described with reference to FIGS. 1 through 5.

Figure 1:
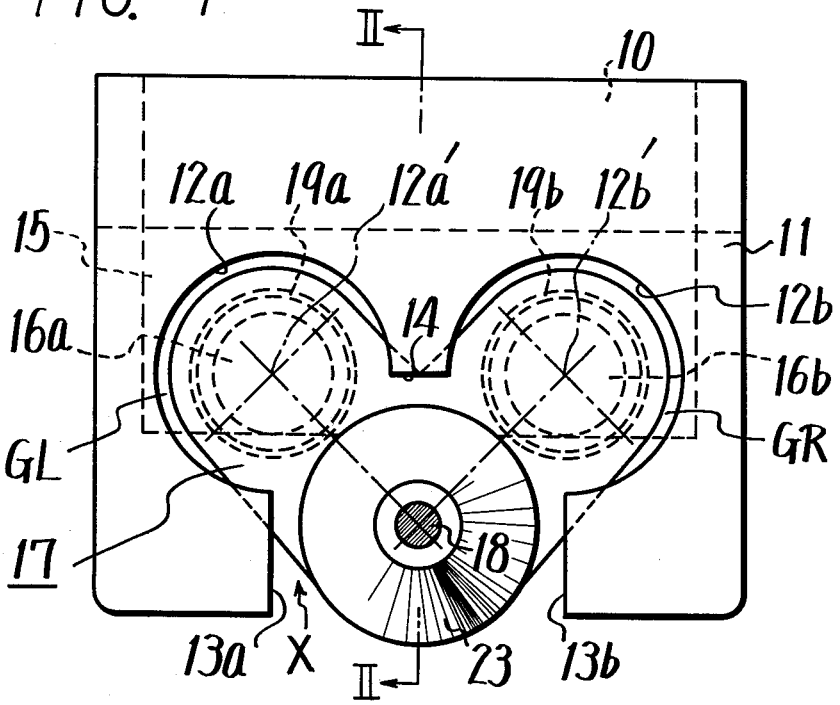
FIG. 1 is a front view showing essential parts of an example of the moving coil pickup cartridge according to the present invention.
Figure 2:
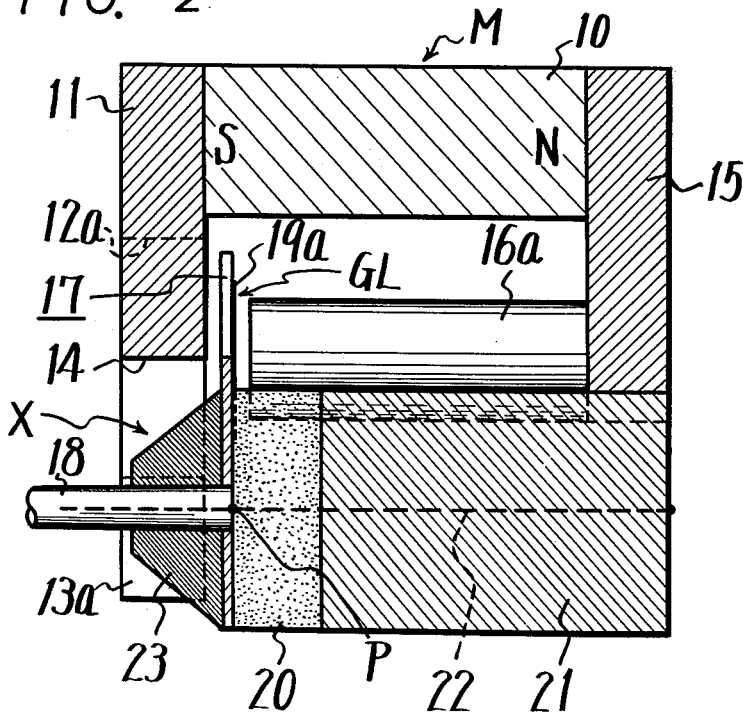
FIG. 2 is a cross-sectional view taken on the line II—II in FIG. 1.
Figure 10:
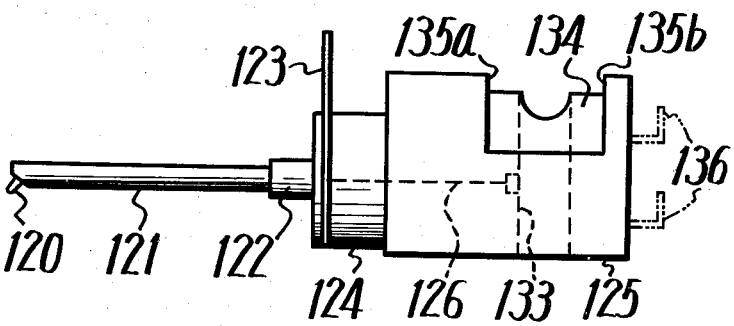
FIG. 10 is a side view showing an exchange stylus portion of the example shown in FIGS. 6 to 9.

In FIGS. 1 and 2, 10 designates a magnet of, for example, a rectangular shape which is so selected that its left to right width is longer than its depth, and 11 a plate which is extended downwards in front surface, for example, S-pole of the magnet 10. As shown in FIGS. 1 and 2, this plate 11 is of a plate-shape and has symmetrical communicated openings 12*a* and 12*b* at the left and right positions. In this case, if the axis of a cantilever 18, which will be described later, is taken as a top, the angle between the line, which connects an axis 12*a*′ of the opening 12*a* with the axis of the cantilever 18, and the line, which connects an axis 12*b*′ of the opening 12*b* with the axis of the cantilever 18, is selected as 90°. A recess X is formed in the plate 11. This recess X is communicated to the openings 12*a* and 12*b* and has opposing surfaces 13*a* and 13*b*. The recess X has a central edge surface 14 with a suitable transverse width. A yoke 15 of a plate-shape is fixed to the N-pole of the magnet 10 and extended downwards to a predetermined position. First and second pole pieces 16*a* and 16*b* are respectively projected from the inner surface of the yoke 15 which are circular posts symmetrical with respect to the center line therebetween, oppose the openings 12*a* and 12*b*, have the axes coincident with those of the latter and have the diameter, for example, one-half of the diameter of the openings 12*a* and 12*b*, respectively. Between the free ends of the pole pieces 16*a*, 16*b* and the inner surface of the plate 11 there is provided a certain distance or gap. In this case, the magnet 10, plate 11, yoke 15 and pole pieces 16*a*, 16*b* form a magnetic circuit M.

Figure 4:
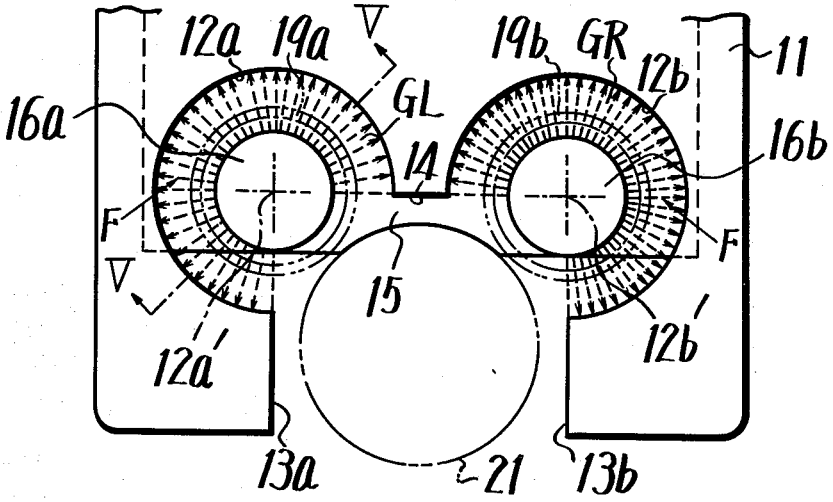
FIG. 4 is a partial view of FIG. 1 used for explaining the magnetic flux of the magnetic gap.
Figure 5:
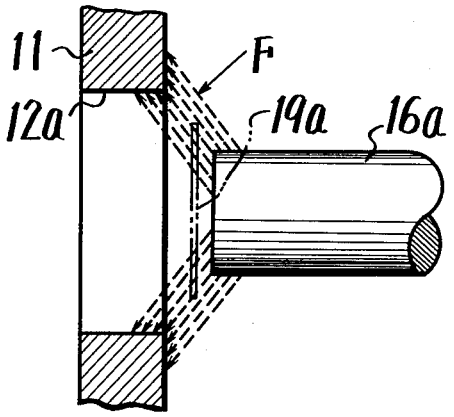
FIG. 5 is a cross-sectional view taken on the line V—V in FIG. 4.
Figure 6:
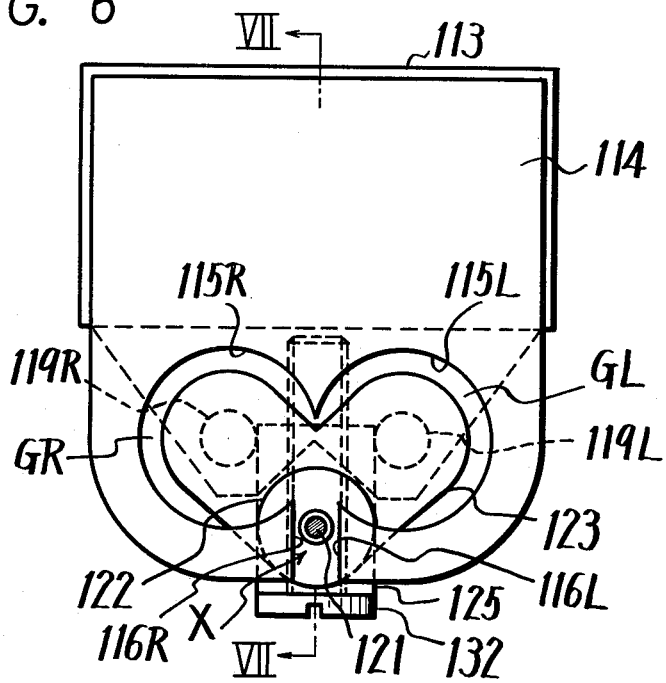
FIG. 6 is a front view showing another example of the moving coil pickup cartridge according to the invention.
Figure 7:
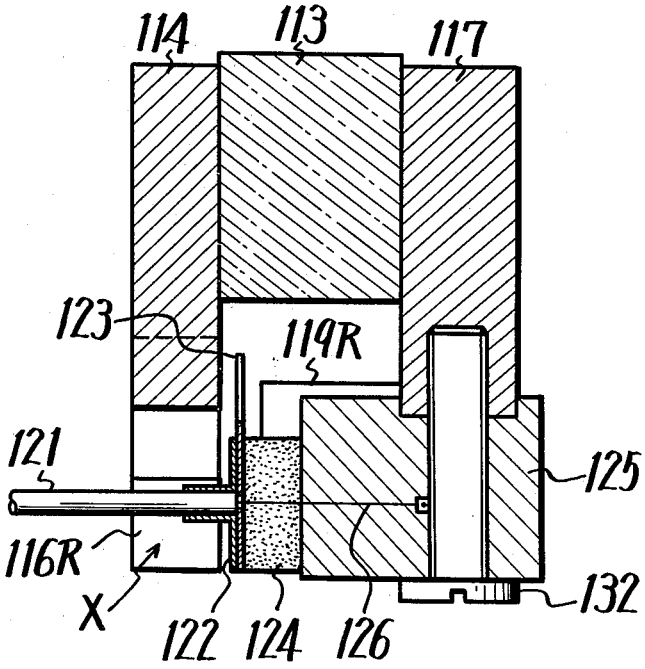
FIG. 7 is a cross-sectional view taken on the line VII—VII in FIG. 6.
Figure 8:
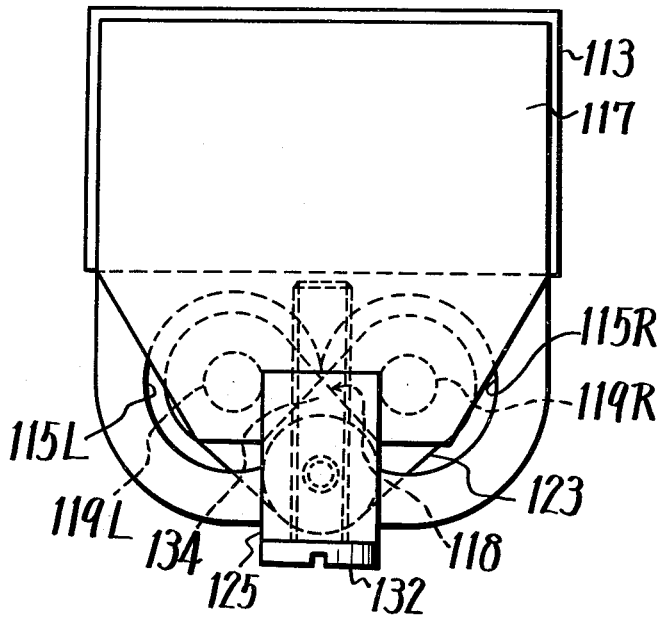
FIG. 8 is a back view of the moving coil pickup cartridge shown in FIG. 6.
Figure 9:
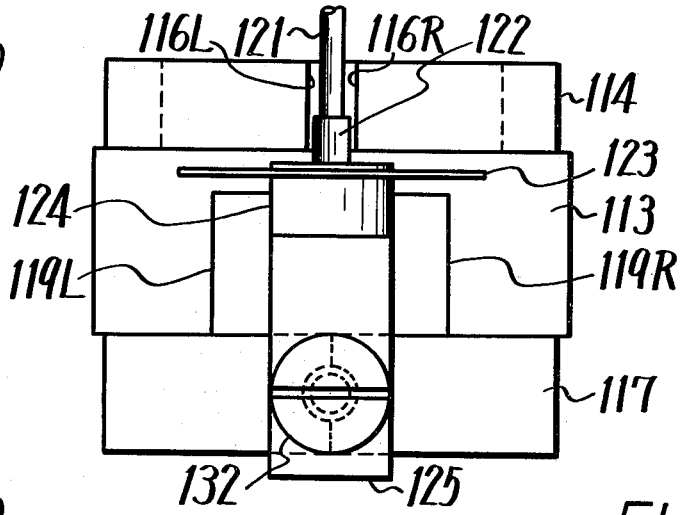
FIG. 9 is a bottom view thereof.

For the plate 11, a first magnetic gap GL (for the left channel L) and a second magnetic gap GR (for the right channel R) are respectively formed by the first and second pole pieces 16*a* and 16*b*. In this case, it should be noted that since the plate 11 has the communicated openings 12*a* and 12 as set forth above, the magnetic flux in each of the respective magnetic fields becomes of a cone-shape except the communicated portion 14. That is, as shown in FIGS. 4 and 5, the magnetic flux F in each of the first and second magnetic gaps GL and GR for the left and right channels expands like an umbrella between the edge portion near the inside of each of the openings 12*a*, 12*b* formed in the plate 11 and the portion about the free end of each of the pole pieces 16*a*, 16*b*. In this invention, the above shape of the magnetic flux F will be defined as a cone-radial shape, but the cone-shape per se does not always mean a circular cross-section. In FIGS. 4 and 5, the respective references are used in response to those of FIGS. 1 and 2.

Figure 3:
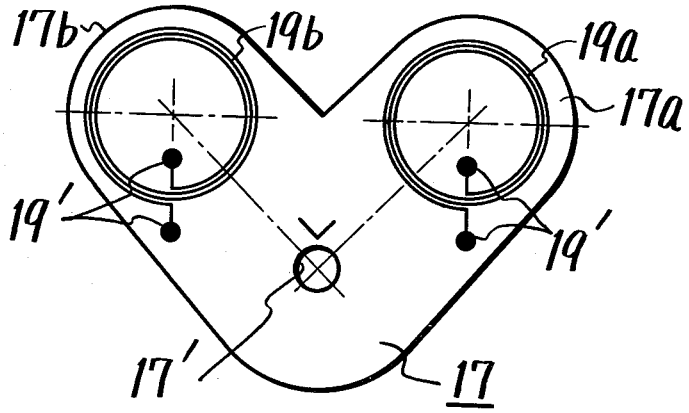
FIG. 3 is a backview showing the coil base plate shown in FIG. 1.

In the first and second magnetic gaps GL and GR, provided are coils as electrical signal generating means for the left and right channels so as to produce or induce voltages from the coils, respectively. That is, in the first example of the invention, as shown in FIG. 1, in order to make the centers of the coils coincident with the axes of the openings 12*a*, 12*b* and those of the pole pieces 16*a*, 16*b*, a V-shaped insulating or coil base plate 17 is provided whose two leg portions extend into the first and second magnetic gaps GL and GR, respectively. The cantilever 18 is attached to the center of the coil base plate 17 where the axes of its both leg portions intersect. Thus, the cantilever 18 extends through the recess X of the plate 11 under portion 14 as shown in FIG. 2. As shown in FIG. 3, on one surfaces, for example, inner surfaces of leg portions 17*a* and 17*b* of the V-shaped coil base plate 17, provided are spiral coils by vaporizing conductive material and then etching the same. These spiral coils are used as coils 19*a* and 19*b* for the left and right channels, respectively, and are located in the first and second magnetic gaps GL and GR, respectively. Accordingly, when the stylus (not shown) of the cantilever 18 traces the sound groove of a record disc, induced voltages are obtained from the respective coils 19*a* and 19*b* in response to the left and right channels.

As shown in FIG. 2, the inner surface of the base portion of the coil plate 17 is attached through a circular damper 20 made of butyl rubber and having a certain thickness to a cylindrical supporting block 21 made of non-magnetic material. This supporting block 21 is in turn fixed to the yoke 15. The circular damper 20 is merely in close contacts at their both surfaces with the coil base plate 17 and the supporting block 21. The coil base plate 17, cantilever 18 and supporting block 21 are coupled by a suspension wire 22. In this case, the vibration fulcrum of the coil base plate 17 is substantially coincident with a central point P at the base portion of the cantilever 18. In the figure, 23 designates an attaching ring which serves to fix the cantilever 18 to the coil base plate 17.

Now, the coil base plate 17 and the pattern of the coils 19*a* and 19*b* for the left and right channels will be now described in detail with reference to FIG. 3. The coil base plate 17 is made of a ceramic plate or other synthetic resin plate with the thickness of about 0.3 mm. On one surfaces of the V-shaped leg portions 17*a* and 17*b* of the coil base plate 17 (the inner surface in correspondence with FIGS. 1 and 2) there are formed the coils 19*a* and 19*b*, the number of turns of each of which is 5 to 10 turns, by, for example, vaporing technique of Al, as the form of conductive layers with the centers on the lines opened from a bore 17' through which the cantilever 18 passes. In this case, as set forth above, these coils 19*a* and 19*b* are each made as a spiral by the etching technique. The width of each line of the respective coils 19*a* and 19*b* is selected as 1.0 to 2.0μand the ends of each of the coils 19*a* and 19*b* have provided with lead wire attaching portions 19'. In the example shown in FIG. 3, 19*a* is the generating coil for the left channel and 19*b* is the generating coil for the right channel, respectively.

As described above, the coils 19*a* and 19*b* for the left and right channels are positioned within the cone-shaped magnetic fluxes of the first and second magnetic gaps GL and GR, respectively (refer to FIGS. 4 and 5). Now, it be assumed that the cantilever 18 is vibrated with the fulcrum P as the center by the channel-L signal of the sound groove of the record disc. Under this assumption, a motion in the forward and backward directions is generated in the coil 19*a* and hence this coil 19*a* crosses the magnetic flux F with the result that voltage is induced in the coil 19*a*. In this case, however since the coil 19*b* performs a mere rotating motion, no voltage is induced in the coil 19*b*. While, when the cantilever 18 is vibrated similarly by the channel-R signal, the opposite phenomenon is caused. Thus, the channel-L and channel-R are clearly separated.

Thus, according to the present invention, almost all the defects encountered in the prior art moving coil pickup cartridge can be removed. Especially, the spiral coils for the left and right channels are respectively positioned in the magnetic fields each having the cone-shape magnetic flux to improve the signal conversion efficiency and also to reduce the equivalent mass of the vibrating system. The conversion efficiency is further improved by making the vibration fulcrum of the coil base plate, which supports the spiral coils, substantially coincident with the vibration fulcrum of the cantilever (in the above example, coincident). Further, the assembly of the cartridge of the invention becomes easy as compared with the prior art.

Another example of the invention will be now described with reference to FIGS. 6 to 11 in which a stylus can be easily exchanged. In this second example of the invention, similar to the first example, the power generating mechanism is formed of a magnet 113, a plate 114 having a pair of openings 115L, 115R, a back yoke 117, first and second pole pieces 119L, 119R fixed to the yoke 117, a pair of magnetic gaps GL, GR established between the pole pieces 119L, 119R and plate 114, and a coil unit 123 having spiral coils and located in the magnetic gaps. An attaching block 125 of a stylus exchanging portion, which will be described later, is provided. At the central portion of the lower surface of the yoke 117, there is formed a V-shaped groove 118 at which a V-shaped projection 134 formed on the attaching block 125 is positioned. A screw bore for screw bolt 132 is also formed in the lower surface of the yoke 117 at the same position.

Figure 11:
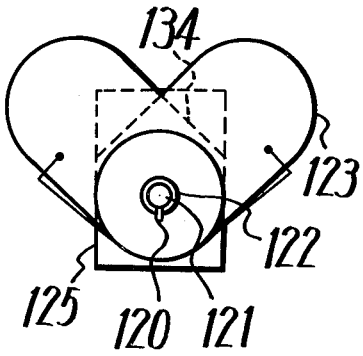
FIG. 11 is a front view thereof.

An exchanging stylus portion shown in FIG. 10 is detachable for the magnetic circuit. That is as shown in FIGS. 10 and 11, the exchanging stylus portion is formed of a cantilever 121 having a stylus 120, a holder 122 for the cantilever 121, the coil unit 123, a damper 124 and the attaching block 125 made of non-magnetic material. The holder 122 is of a disc shape and has provided with a boss at the center therof. One end of the cantilever 121 is engaged within the boss of the holder 122 and is pulled backward by a suspension wire 126. Thus, the coil unit 123 and the disc-shaped damper 124 are urged against the front surface of the attaching block 125, whereby these elements are made close to one another. Accordingly, the coil unit 123 is positioned at one end of the cantilever 121 as the vibration fulcrum.

The attaching block 125 made of non-magnetic material is of a rectangular shape and has provided with a screw bore 133 to which the bolt 132 is threaded and the V-shaped projection 134 engaged with the V-shaped groove 118 formed on the lower surface of the back yoke 117. At the front and back end portions of the V-shaped projection 134, there are provided steps 135*a* and 135*b*, respectively. When the above exchanging stylus portion is assembled to the magnetic circuit, the cantilever 121 is passed through the recess X of the plate 114 and the V-shaped groove 118 and the V-shaped projection 134 are engaged. Thus, the positioning of the exchanging stylus portion in its height, left and right directions is performed, and its positioning in forward and backward directions is performed by the steps 135*a* and 135*b*. Thus, the exchanging stylus portion is positioned at the normal state in which the cantilever 121 is positioned between opposing surfaces 116L and 116R of the recess X formed in the plate 114 and then is fixed to the yoke 117 by the attaching bolt 132. The attachment by the screw bolt 132 is a mere example. That is, the attachment of the exchanging stylus portion may be carried out by a snap manner.

Further, as shown in FIG. 10 by the two-dot chain line, it is possible that, at the back surface of the attaching block 125, a pin-jack 136 is provided as the coupling means or a pin is planted and then soldered.

As will be apparent, according to the second example of the invention as described in connection with FIGS. 6 to 11, its stylus portion can be easily exchanged and is made of such a simple construction that the holder 122, coil unit 123 and rubber damper 124 are successively urged against the front surface of the attaching block 125.

It will be apparent that many modifications and variations could be effected by one skilled in the art without departing from the spirits or scope of the novel concepts of the present invention, so that the spirits or scope of the invention should be determined by the appended claims only.

I claim as my invention:

1. A moving coil pickup cartridge comprising, a bar magnet with north and south poles, a first planar yoke member connected to one end of said bar magnet, a second planar yoke member connected to the opposite end of said bar magnet and formed with a pair of spaced openings, a pair of pole pieces of magnetic material attached to said first yoke member and extending toward said second yoke member and terminating adjacent said spaced openings and with at least the ends of said pole pieces generally rounded adjacent said openings so that a conical shaped magnetic field exists between the ends of said pole pieces and said second planar yoke, an L-shaped coil base plate with a pair of arms extending into the air gaps between the ends of said pole pieces and openings in said second yoke to intercept said conical-shaped magnetic fields, a pickup pair of coils attached to arms and mounted in said conical-shaped magnetic fields, a damper means in engagement with said L-shaped plate at the junction of said legs, means flexibly attaching said L-shaped plate to said damper means and a cantilever for supporting stylus attached to said L-shaped plate at the junction of said legs.

2. A moving coil pickup according to claim 1 wherein said L-shaped legs are orientated 90 degrees to each other.

3. A moving coil pickup according to claim 2 wherein said pair of coils are formed in spiral-shaped on said arms of said L-shaped coil base plate which has insulating surfaces formed thereon.

4. A moving coil pickup according to claim 3 wherein said pair of spiral-shaped coils are formed by vaporization.

5. A moving coil pick-up according to claim 3 wherein said L-shaped plate is formed of insulating material and has an opening at the junction of said legs through which a wire extends to connect said cantilever to said pickup.

6. A moving coil pickup according to claim 5 including a non-magnetic block attached to said first yoke and said L-shaped plate, said wire and said damper means attached to said block.

7. A moving coil pickup according to claim 6 including a bolt for attaching said non-magnetic block and cantilever to said first yoke.

8. A moving coil pickup according to claim 7 wherein a mating notch is formed between said non-magnetic block and said first yoke for molding and aligning said members.

* * * * *